US010265879B2

(12) United States Patent
Chang

(10) Patent No.: US 10,265,879 B2
(45) Date of Patent: Apr. 23, 2019

(54) WORKING HEIGHT ADJUSTMENT DEVICE OF PROCESSING MACHINE

(71) Applicant: KINGSAND MACHINERY LTD., Taichung (TW)

(72) Inventor: Chin-Feng Chang, Taichung (TW)

(73) Assignee: KINGSAND MACHINERY LTD., Taichung (TW)

( * ) Notice: Subject to any disclaimer, the term of this patent is extended or adjusted under 35 U.S.C. 154(b) by 756 days.

(21) Appl. No.: 14/754,643

(22) Filed: Jun. 29, 2015

(65) Prior Publication Data

US 2016/0375603 A1 Dec. 29, 2016

(51) Int. Cl.
*B27C 1/14* (2006.01)
*B24B 7/28* (2006.01)

(52) U.S. Cl.
CPC . *B27C 1/14* (2013.01); *B24B 7/28* (2013.01)

(58) Field of Classification Search
CPC .... B27C 1/00; B27C 1/02; B27C 1/04; B27C 1/06; B27C 1/08; B27C 1/14; B27C 5/00; B27C 5/10; B27C 9/00; B27C 9/005; B27C 9/02; B23C 1/02; B23C 1/025; B23C 2245/00; B23B 2205/04; B23B 2205/12; B23B 27/1655; B23B 27/1681; B23B 27/1685; B23B 29/18; Y10T 409/307952; Y10T 409/30784; B25B 1/00; B25B 1/14; B25B 1/10; B25B 3/00; B25B 5/00
USPC ..... 144/92, 104, 106, 108, 129, 130; 269/228, 73, 902
See application file for complete search history.

(56) References Cited

U.S. PATENT DOCUMENTS 3,303,732 A * 2/1967 Gill ..... B28B 21/92 144/205
5,927,357 A * 7/1999 Welsh ..... B23Q 1/285 144/114.1

* cited by examiner

*Primary Examiner* — Matthew Katcoff
(74) *Attorney, Agent, or Firm* — Raymond Y. Chan; David and Raymond Patent Firm

(57) ABSTRACT

A working height adjustment device of a processing machine includes a slide seat mounted to a fixing frame seat. The slide seat is provided with an adjustment seat having a through hole. The through hole is inserted with a micro adjustment rod having a threaded section. The micro adjustment rod is pivotally connected with a rotatable handle. A control rod having a link rod is provided between the fixing frame seat and the slide seat. The adjustment seat has an accommodation hole which is provided with an elastic member, a movable member and a push knob. The movable member has an engaging hole. One side of the engaging hole is formed with a toothed portion. The threaded section of the micro adjustment rod passes through the engaging hole. One end of the movable member is inserted into the elastic member, and another end is connected with the push knob.

6 Claims, 7 Drawing Sheets

WORKING HEIGHT ADJUSTMENT DEVICE OF PROCESSING MACHINE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a working height adjustment device of a processing machine, and more particularly to a processing machine which can be switched for a fine adjustment or a rapid adjustment.

Description of Related Arts

The height of a cutter seat provided on a woodworking processing machine, such as a wood planing machine, a grinding machine, and the like, needs to be adjusted according to the thickness of the wood to be proceeded. As shown in FIG. 1, a conventional woodworking processing machine 10 comprises side protruding boards 111 at two inner sides of a fixing frame seat 11. Two sides of a slide seat 13 are provided with rail grooves 131. In cooperation with bolts passing through the side protruding boards 111 and the rail grooves 131, the slide seat 13 is coupled to the fixing frame seat 11. The slide seat 13 can be slid up and down relative to the fixing frame seat 11. One side of the slide seat 13 is coupled with a connecting end 141 of a cutter seat 14, and another opposing side of the slide seat 13 is coupled with a motor 15. A turning axle of the motor 15 passes through a penetrating hole 133 of the fixing frame seat 11 to connect with a coupling member 142 of the cutter seat 14 to turn, such that the cutter seat 14 and the motor 15 are simultaneously moved up and down along with the slide seat 13. A top central portion of the slide seat 13 is provided with an adjustment seat 132. The adjustment seat 132 is pivotally connected with a micro adjustment rod 16 having a threaded section 161. An upper end of the micro adjustment rod 16 extends out of the fixing frame seat 11 and is pivotally connected with a rotatable handle 17. By turning the rotatable handle 17, the slide seat 13 can be ascended or descended, enabling the cutter seat 14 to move up or down so as to adjust the distance between the cutter seat 14 and a working platform 12 for the wood in a different size or thickness. However, if the difference in size between the former wood and the latter wood to be processed is great, the slide seat 13 is slowly moved by turning the rotatable handle 17 to link the micro adjustment rod 16. The speed to ascend or descend the slide seat 13 is slow and consumes energy and time. This is not convenient for use. In view of this, it is necessary to improve the processing machine 10 for a timesaving and convenient adjustment. Accordingly, the inventor of the present invention has devoted himself based on his many years of practical experiences to solve these problems.

SUMMARY OF THE PRESENT INVENTION

The primary object of the present invention is to provide a working height adjustment device of a processing machine to solve the aforesaid problems.

In order to achieve the aforesaid object, the working height adjustment device of the processing machine of the present invention comprises a slide seat, a fixing frame, and a control rod with a link rod pivotally connected between the fixing frame seat and the slide seat. The slide seat is provided with an adjustment seat. The adjustment seat of the slide seat has a transverse accommodation hole. The accommodation hole is provided with an elastic member, a movable member and a push knob in sequence. The movable member has an engaging hole. The engaging hole has a diameter larger than that of the micro adjustment rod. One side of the engaging hole is formed with a toothed portion. By pressing or releasing the push knob, the movable member enables the toothed portion of the engaging hole to engage with or disengage from the threaded portion of the micro adjustment rod, such that the micro adjustment rod can be rotated or the control rod can be pulled up and down to displace the slide seat rapidly. The present invention is timesaving and can be used conveniently.

DETAILED DESCRIPTION OF THE PREFERRED EMBODIMENT

Figure 1:
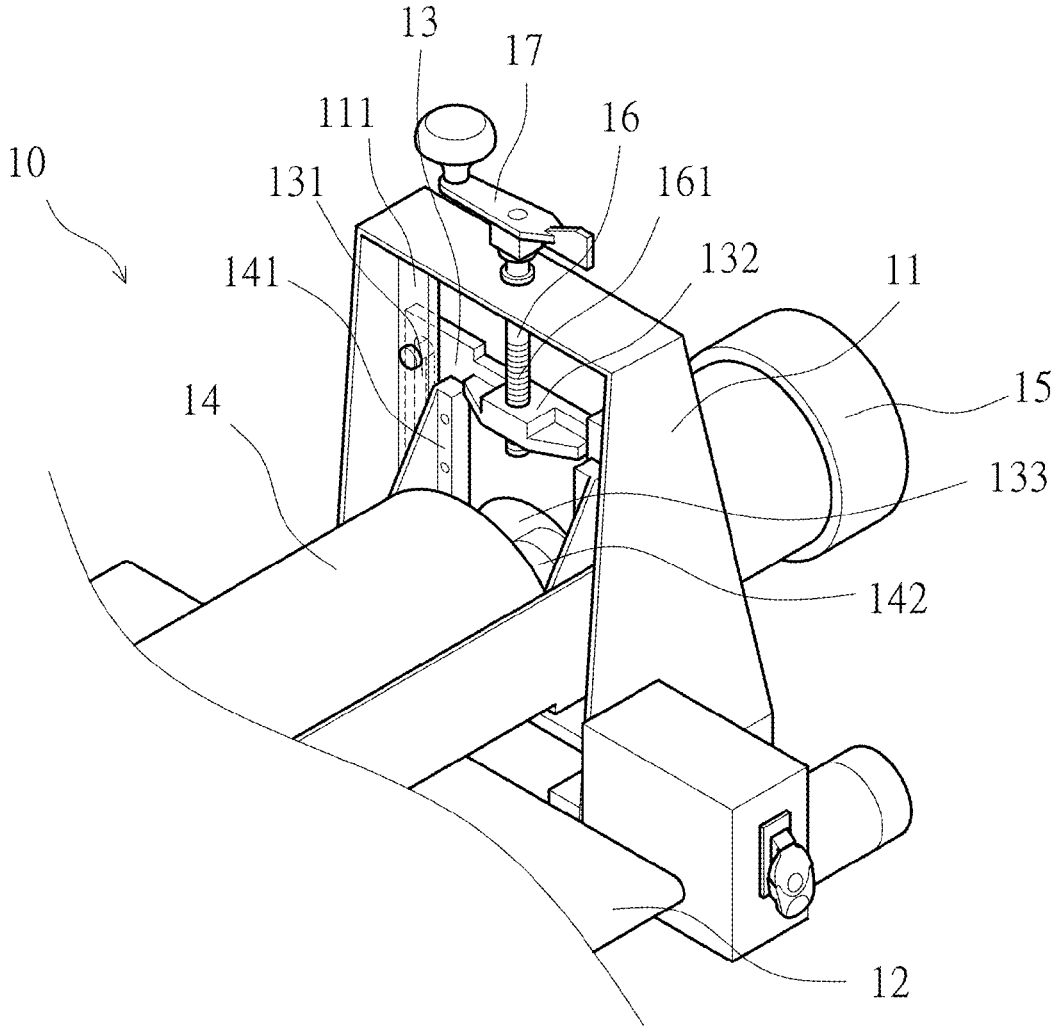
FIG. 1 is a perspective view of a conventional processing machine.
Figure 2:
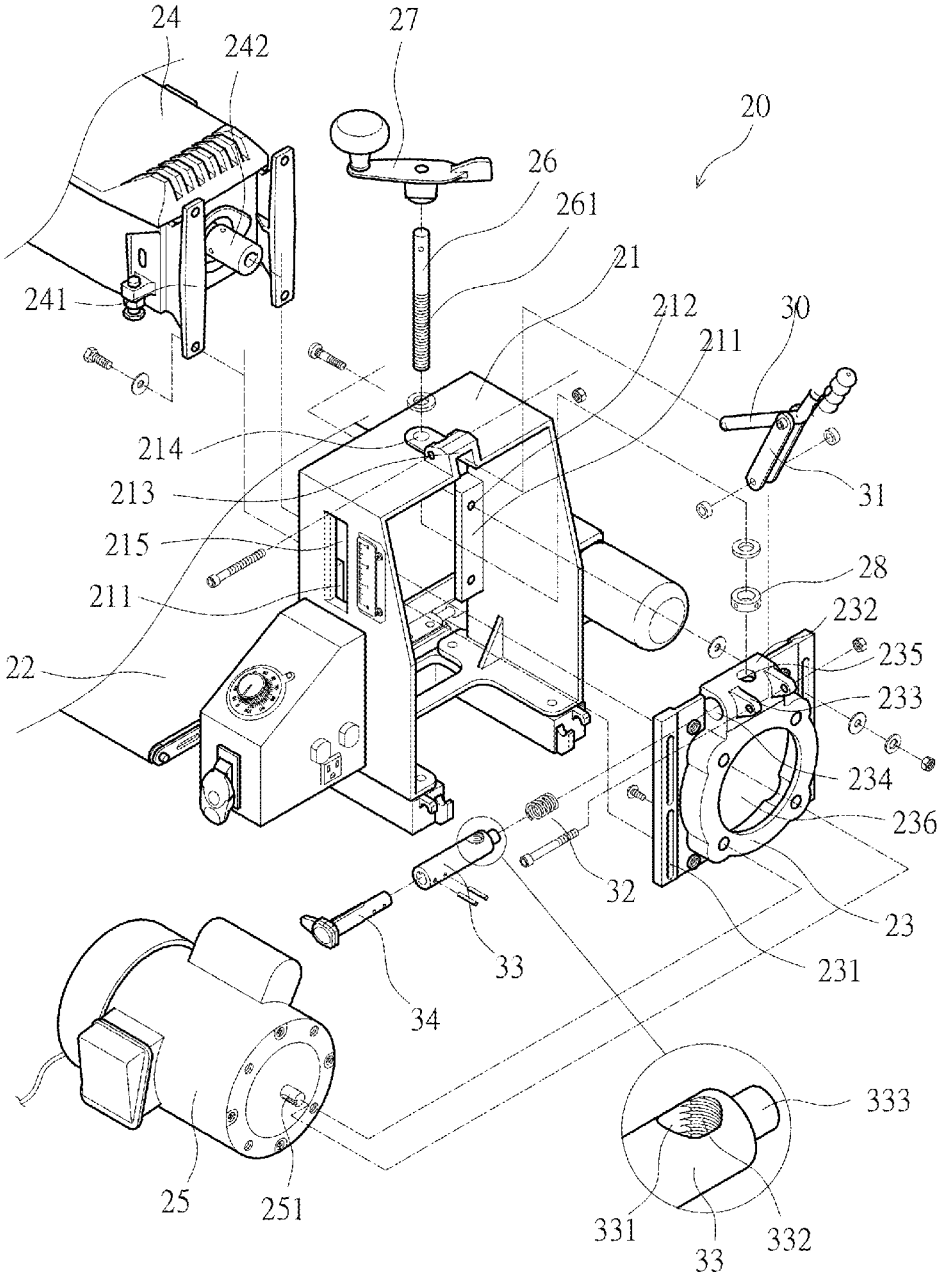
FIG. 2 is an exploded view according to a preferred embodiment of the present invention.
Figure 3:
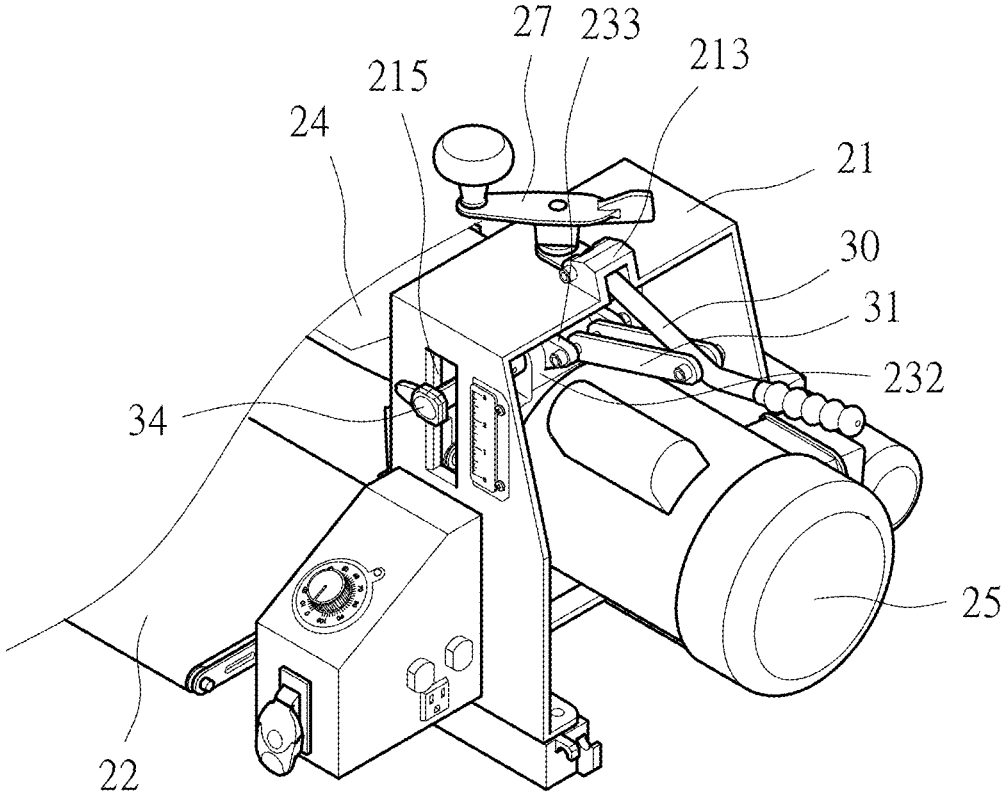
FIG. 3 is a perspective view according to the preferred embodiment of the present invention.

Embodiments of the present invention will now be described, by way of example only, with reference to the accompanying drawings.

Referring to FIG. 2 through FIG. 5, the present invention discloses a processing machine 20. The processing machine 20 comprises a slide seat 23 vertically and slidably mounted to a fixing frame seat 21. One side of the slide seat 23 is coupled with a cutter seat 24, and another opposing side of the slide seat 23 is coupled with a motor 25. A top central portion of the slide seat 23 is provided with an adjustment seat 232 having a through hole 235. The through hole 235 is inserted with a micro adjustment rod 26 having a threaded section 261. An upper end of the micro adjustment rod 26 extends out of the fixing frame seat 21 and is pivotally connected with a rotatable handle 27. A top edge of the fixing frame seat 21 is provided with an axle seat 213. A top end of the slide seat 23 is provided with a pivot seat 233. The axle seat 213 is pivotally connected with one end of a control rod 30. The pivot seat 233 is pivotally connected with one end of a link rod 31. Another end of the link rod 31 is pivotally connected to the control rod 30. The adjustment seat 232 of the slide seat 23 has a transverse accommodation hole 234 communicating with the through hole 235. The accommodation hole 234 is provided with an elastic member 32, a movable member 33, and a push knob 34 in sequence. The movable member 33 has an engaging hole 331 corresponding to the through hole 235. The engaging hole 331 has a diameter larger than that of the micro adjustment rod 26. One side of the engaging hole 331 is formed with a toothed portion 332. The threaded section 261 of the micro adjustment rod 26 passes through the engaging hole 331. One end of the movable member 33 is provided with an axial protruding post 333 to be inserted into the elastic member 32. Another end of the movable member 33 is connected with the push knob 34.

Through the aforesaid device, the toothed portion 332 of the engaging hole 331 engages with the threaded portion 261 of the micro adjustment rod 26. When the push knob 34 is pushed, the movable member 33 enables the toothed portion 332 to disengage from the micro adjustment rod 26. The control rod 30 is simultaneously pulled up and down, enabling the link rod 31 to directly link the slide seat 23 so as to rapidly adjust descent or ascent of the cutter seat 24. This way saves time and is very convenient.

The assembly the present invention is described hereinafter. Referring to FIG. 2 to FIG. 5, two side protruding boards 211 are provided with two bolt holes 212, respectively. Bolts are inserted through the bolt holes 212 and rail grooves 231 of the slide seat 23, such that the slide seat 23 is mounted to the corresponding side protruding board 211 and slidable in the direction of the rail grooves 231. A coupling end 241 of the cutter seat 24 and the motor 25 are both coupled to the slide seat 23. A turning axle 251 of the motor 25 passes through a penetrating hole 236 to connect with a coupling member 242 of the cutter seat 24 to turn, such that the slide seat 23, the cutter seat 24 and the motor 25 are displaced vertically simultaneously so as to adjust and change the working height between the cutter seat 24 and a working platform 22 for different thicknesses and sizes of wood. For the micro adjustment rod 26 to be pivoted to a through hole 214 of the fixing frame seat 21, the bottom side of the fixing frame seat 21 is provided with a positioning ring 28 so that the micro adjustment rod 26 can rotate and won't depart from the through hole 214 of the fixing frame seat 21. The diameter of the through hole 235 of the adjustment seat 232 is greater than that of the micro adjustment rod 26, so they won't contact with each other. The toothed portion 332 is disposed in the engaging hole 331 and located at the same side as the elastic member 32. In this embodiment, the elastic member 32 is a compression spring. The movable member 33 in the accommodation hole 234 is biased by the elasticity of the elastic member 32, enabling the toothed portion 332 to engage with the threaded portion 261 of the micro adjustment rod 26. For controlling the movable member 33 easily, one side of the fixing frame seat 21 is provided with an opening 215. One end of the push knob 34 is inserted into the movable member 33, and another end of the push knob 34 extends outward and is exposed out of the opening 215 for the push knob 34 and the movable member 33 to be pressed externally with ease.

Furthermore, the pivot seat 233 is disposed on the adjustment seat 232 of the slide seat 23 to be displaced along with the slide seat 23 simultaneously, which is a movable pivot. The axle seat 213 of the fixing frame seat 21 is an immovable pivot. The control rod 30 and the link rod 31 are pivoted to be a Y-shaped configuration. When turned, the ends of the two rods can change their relative distance. Therefore, when the control rod 30 is pulled up and down, the link rod 31 is driven by the control rod 30 to link and move the slide seat 23 up and down. In this way, the slide seat 23 can be displaced rapidly by means of a large route, not ascending/descending slowly by a screwed movement. Thus, the slide seat 23 is controlled to reach a preset position at a very short time to achieve time-saving and convenient effects.

Figure 4:
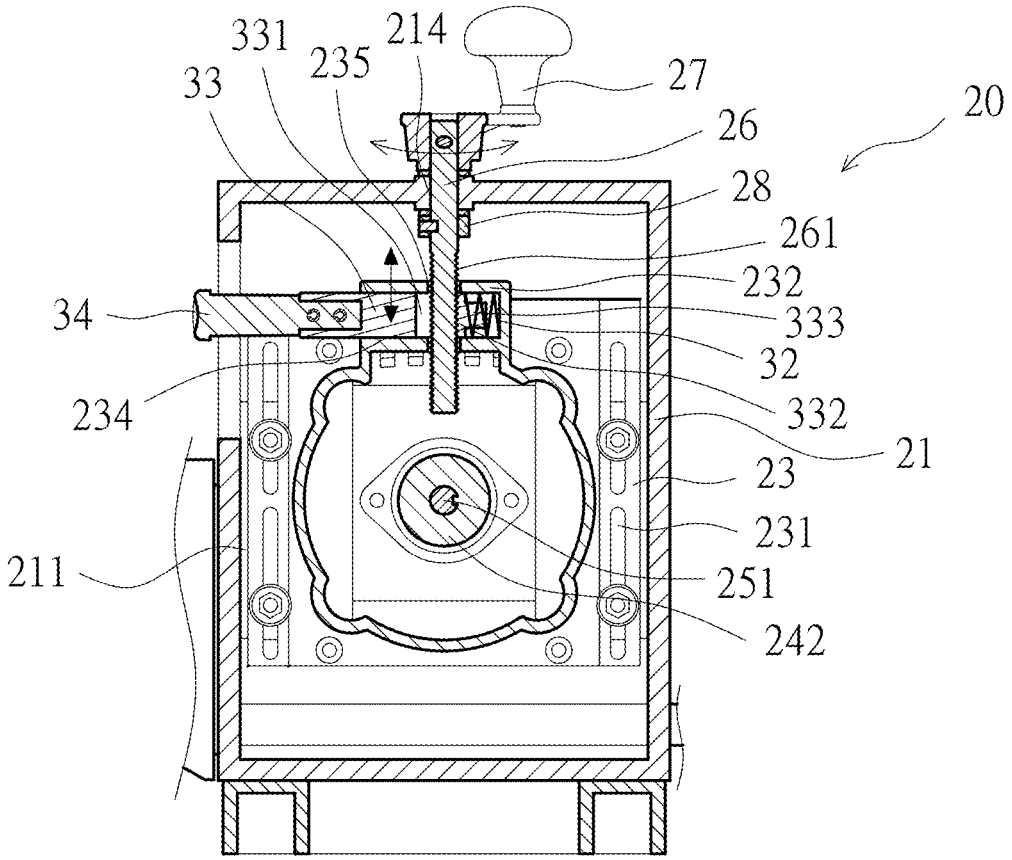
FIG. 4 is a front sectional view showing that the cutter seat is adjusted finely according to the preferred embodiment of the present invention.
Figure 5:
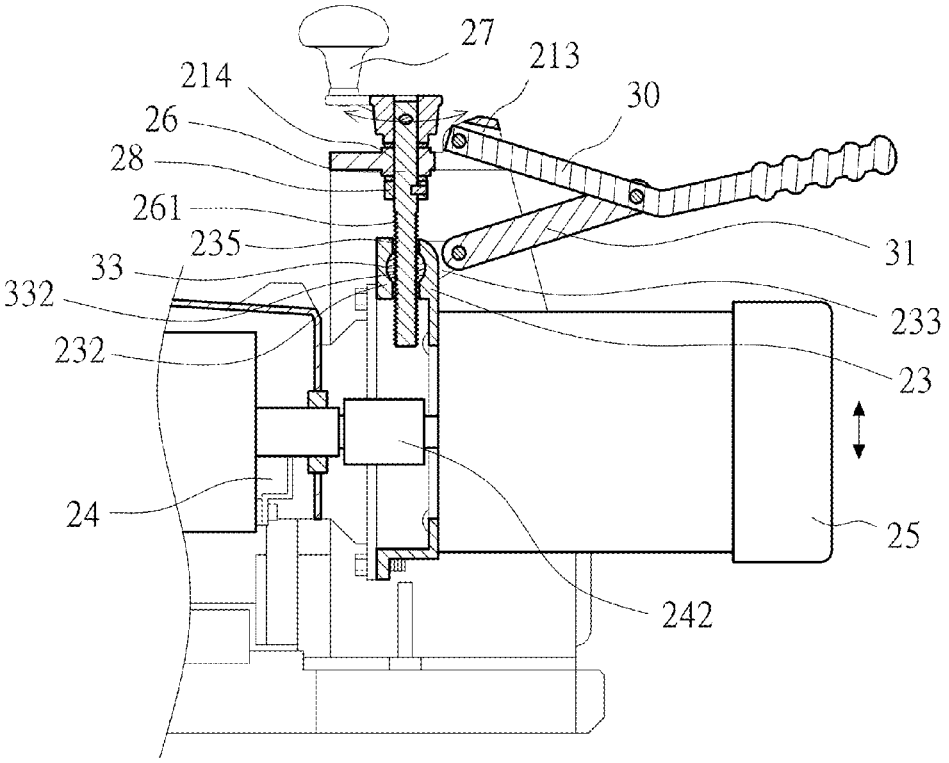
FIG. 5 is a side sectional view showing that the cutter seat is adjusted finely according to the preferred embodiment of the present invention.

Referring to FIG. 4 and FIG. 5, the movable member 33 is biased by the elasticity of the elastic member 32, enabling the toothed portion 332 to engage with the threaded portion 261. At this time, if the control rod 30 is pulled up and down, it is unable to bring the slide seat 23 to displace. Only the rotatable handle 27 and the micro adjustment rod 26 can be rotated to move the slide seat 23. Therefore, the height distance between the cutter seat 24 and the working platform 22 can be adjusted slowly and finely. This action is suitable for a slight difference in thickness and in size between the former wood and the latter wood to be processed.

Figure 6:
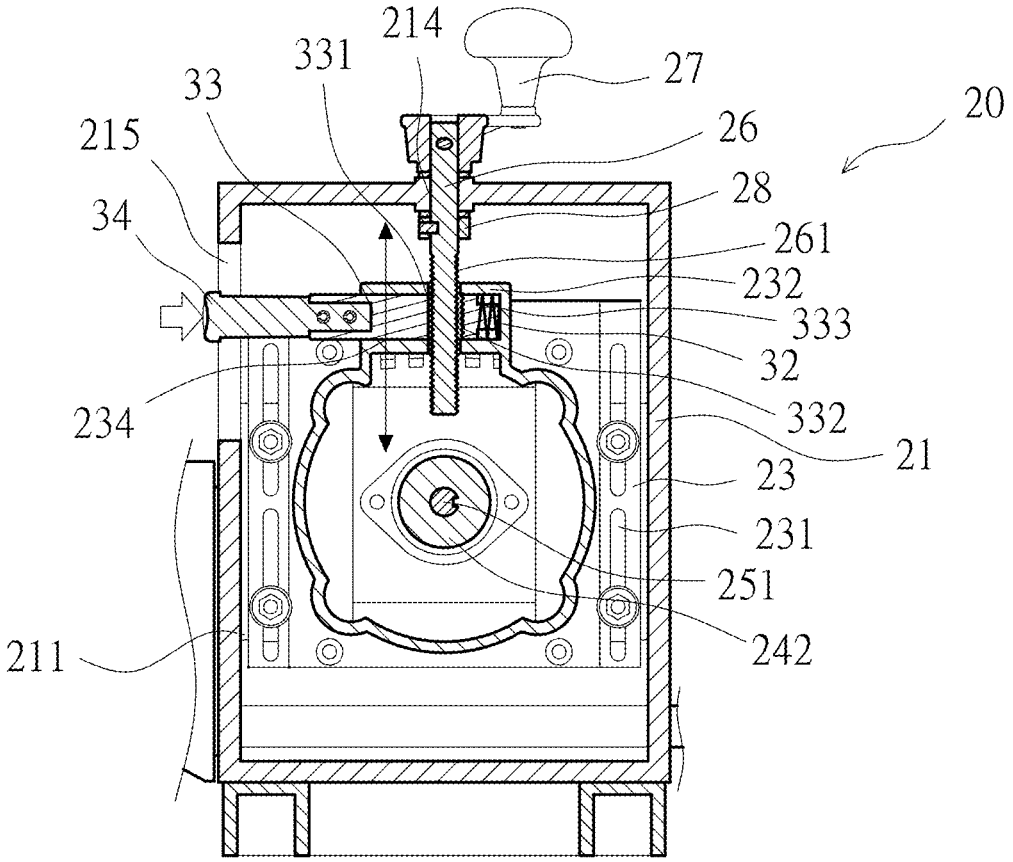
FIG. 6 is a front sectional view showing that the cutter seat is adjusted rapidly by the control rod according to the preferred embodiment of the present invention.
Figure 7:
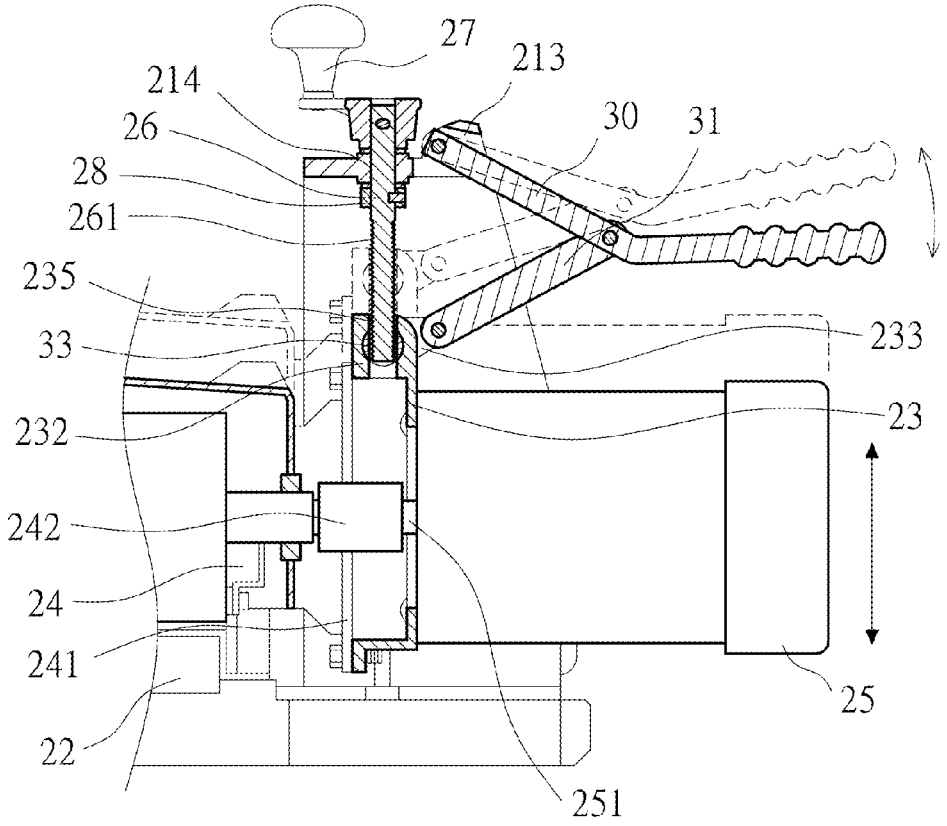
FIG. 7 is a side sectional view showing that the cutter seat is adjusted rapidly by the control rod according to the preferred embodiment of the present invention.

Referring to FIG. 6 and FIG. 7, when the push knob 34 and the movable member 33 are pressed, the movable member 33 will compress the elastic member 32, enabling the toothed portion 332 to disengage from the threaded portion 261. At this time, if the rotatable handle 27 is rotated, the micro adjustment rod 26 will be idle and unable to displace the slide seat 23. Therefore, the height distance between the cutter seat 24 and the working platform 22 can be adjusted greatly. This action is suitable for a larger difference in thickness and in size between the former wood and the latter wood to be processed. The operation is that the user first holds the control rod 30 and then presses the push knob 34 and the moveable member 33. The control rod 30 is pulled up and down to directly ascend/descend the slide seat 23. When the cutter seat 24 reaches a desired height for processing, the push knob 34 and the moveable member 33 are released. The movable member 33 is biased by the elasticity of the elastic member 32 again, enabling the toothed portion 332 to engage with the threaded portion 261 of the micro adjustment rod 26. Afterward, the rotatable handle 27 is rotated to adjust the slide seat 23 finely for a precise processing height. The present invention is timesaving and can be used conveniently.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A working height adjustment device of a processing machine, comprising a slide seat vertically and slidably mounted to a fixing frame seat; one side of the slide seat being coupled with a cutter seat, another opposing side of the slide seat being coupled with a motor; a top central portion of the slide seat being provided with an adjustment seat having a through hole, the through hole being inserted with a micro adjustment rod having a threaded section, an upper end of the micro adjustment rod extending out of the fixing frame seat and being pivotally connected with a rotatable handle; the fixing frame seat being provided with an axle seat, the slide seat being provided with a pivot seat, the axle seat being pivotally connected with one end of a control rod, the pivot seat being pivotally connected with one end of a link rod, another end of the link rod being pivotally connected to the control rod; the adjustment seat of the slide seat having a transverse accommodation hole communicating with the through hole, the accommodation hole being provided with an elastic member and a movable member, the movable member having an engaging hole corresponding to the through hole, the engaging hole having a diameter larger than that of the micro adjustment rod, one side of the engaging hole being formed with a toothed portion, the threaded section of the micro adjustment rod passing through the engaging hole; one end of the movable member being inserted into the elastic member;

thereby, the toothed portion of the engaging hole engaging with the threaded portion of the micro adjustment rod, wherein when the movable member is pressed, the toothed portion disengages from the micro adjustment rod, and the control rod is simultaneously pulled up and down, enabling the link rod to directly link the slide seat so as to rapidly adjust descent or ascent of the cutter seat.

2. The working height adjustment device of a processing machine as claimed in claim 1, wherein one end of the movable member is provided with an axial protruding post to be inserted into the elastic member.

3. The working height adjustment device of a processing machine as claimed in claim 1, wherein another end of the movable member is connected with a push knob.

4. The working height adjustment device of a processing machine as claimed in claim 3, wherein one side of the fixing frame seat is provided with an opening, and the push knob extends outward and is exposed out of the opening.

5. The working height adjustment device of a processing machine as claimed in claim 1, wherein the toothed portion is disposed in the engaging hole and located at the same side as the elastic member.

6. The working height adjustment device of a processing machine as claimed in claim 1, wherein the control rod and the link rod are pivoted to be a Y-shaped configuration.

* * * * *